US009799938B2

(12) United States Patent
Chong et al.

(10) Patent No.: US 9,799,938 B2
(45) Date of Patent: Oct. 24, 2017

(54) METHODS AND DEVICES FOR CONNECTING A RESONATOR TO A FILTER BODY

(71) Applicant: Radio Frequency Systems, Inc., Meriden, CT (US)

(72) Inventors: Yin-Shing Chong, Middletown, PA (US); Peter A. Casey, Clinton, CT (US); Yunchi Zhang, Wallingford, CT (US)

(73) Assignee: Alcatel-Lucent Shanghai Bell Co., Ltd, Shanghai (CN)

( * ) Notice: Subject to any disclaimer, the term of this patent is extended or adjusted under 35 U.S.C. 154(b) by 121 days.

(21) Appl. No.: 14/458,547

(22) Filed: Aug. 13, 2014

(65) Prior Publication Data

US 2016/0049711 A1 Feb. 18, 2016

(51) Int. Cl.

| | |
|---|---|
| ***H01P 1/205*** | (2006.01) |
| ***H01P 7/04*** | (2006.01) |
| *H01P 7/06* | (2006.01) |
| *H01P 7/10* | (2006.01) |

(52) U.S. Cl.

CPC ..... *H01P 1/2053* (2013.01); *H01P 7/04* (2013.01); *H01P 7/06* (2013.01); *H01P 7/10* (2013.01)

(58) Field of Classification Search

CPC ..... H01P 1/202; H01P 1/205; H01P 1/2053; H01P 7/04; H01P 7/06; H01P 7/10

USPC ..... 333/206, 207, 222–226

See application file for complete search history.

(56) References Cited

U.S. PATENT DOCUMENTS

| | | | | |
|---|---|---|---|---|
| 3,516,030 | A * | 6/1970 | Brumbelow | H01P 1/2053 333/209 |
| 4,794,354 | A * | 12/1988 | Dinsmore | H01P 7/04 333/202 |
| 6,335,668 | B1 * | 1/2002 | Henningsson | H01P 7/04 333/202 |
| 6,384,699 | B1 * | 5/2002 | Henningsson | H01P 7/06 333/202 |
| 2006/0038640 | A1 * | 2/2006 | D'Ostilio | H01P 7/04 333/223 |
| 2007/0202920 | A1 * | 8/2007 | Eddy | H01P 1/2053 455/562.1 |
| 2015/0207194 | A1 * | 7/2015 | Chong | H01P 1/207 333/211 |

OTHER PUBLICATIONS

Newman Tools Inc, Thread Data, Oct. 2009, Newman Tools Inc.*

* cited by examiner

*Primary Examiner* — Benny Lee
*Assistant Examiner* — Jorge Salazar, Jr.
(74) *Attorney, Agent, or Firm* — The Capitol Patent & Trademark Law Firm, PLLC

(57) ABSTRACT

A cavity filter includes a threaded resonator and a threaded filter body to improve the coupling of radio frequency signals.

16 Claims, 3 Drawing Sheets

METHODS AND DEVICES FOR CONNECTING A RESONATOR TO A FILTER BODY

INTRODUCTION

Existing wireless base stations utilize "top hat" resonators as a part of a cavity filter that is made a part of an amplification system, where the name "top hat" is derived from the shape of the resonator. Typically, a top hat resonator is connected to a filter body of the cavity filter using a mechanical screw arrangement. However, this connection technique has its disadvantages. For example, once installed the screw may interfere with other components of the filter, such as a tap-pin that is used to couple a radio frequency (RF) signal to a cavity filter. Such interference degrades the operation of the cavity filter.

It is therefore desirable to provide methods and devices for connecting top hat resonators to cavity filters that avoid the disadvantages of existing connection techniques.

It is further desirable to provide methods and devices for connecting top hat resonators to cavity filters that avoid the disadvantages of existing connection techniques.

SUMMARY

Exemplary embodiments of methods and devices for connecting a resonator to a cavity filter are provided.

According to one embodiment, a cavity filter may comprise: a resonator (e.g., top hat resonator) comprising a first threaded portion, the first threaded portion comprising a variable thread size configured to connect to a filter body, and a filter body comprising a second threaded portion, the second threaded portion comprising a variable thread size configured to connect to the first threaded portion. The cavity filter may be part of a tower mounted amplifier or antenna, for example.

In addition to a resonator and filter body, inventive cavity filters may additional comprise a tap pin, where the filter body may be further configured to receive the tap pin at a position that provides satisfactory coupling of an RF signal.

In accordance with embodiments of the invention, by using threaded portions to connect a resonator and filter body an RF signal may be more satisfactorily coupled (i.e., from a resonator to a tap pin).

In yet a further embodiment, a resonator may comprise a first contact area, while a filter body may comprise a second contact area, where the first contact area may be configured to contact the second contact area to form an electrical ground.

Resonators used with the inventive cavity filters may operate over a range of frequencies selected from at least 600 MHz to 960 MHz and 1650 MHz to 2700 MHz, for example.

Regarding the threaded portions, in one embodiment the first and second threaded portions may comprise threads that are 12 millimeters in size, for example. More generally, however, the first and second threaded portions may comprise threads whose size varies based on a size of a re-entrant cavity. Said another way, the first threaded portion of the resonator may comprise a variable thread size that may be configured to connect to the second threaded portion of the filter body (and vice-versa).

While the embodiments above are directed at the combination of a resonator and a filter body it should be understood that alternative embodiments are directed at the component parts of a cavity filter (i.e., a resonator, or a filter body).

In addition to inventive cavity filters and components, the present invention also provides related methods. For example, in one embodiment a method for connecting a resonator to a filter body may comprise: connecting a resonator, comprising a first threaded portion having a variable thread size, to a filter body; and connecting a filter body, comprising a second threaded portion having a variable thread size, to the first threaded portion. Further, the method may comprise receiving a tap pin in the filter body at a position that provides satisfactory coupling of an RF signal.

As before the resonator may be a top hat resonator capable of operating over a range of frequencies selected from at least 600 MHz to 960 MHz and 1650 MHz to 2700 MHz, for example, while the so-connected cavity filter may be part of a tower mounted amplifier or antenna. Still further, the inventive methods may utilize threaded portions whose size may comprise threads that are 12 millimeters in size, or, more generally, whose size may vary based on a size of a re-entrant cavity.

Still further, the method may comprise contacting a first contact area of a resonator with a second contact area of a filter body to form an electrical ground.

Additional features will be apparent from the following detailed description and appended drawings.

EXEMPLARY EMBODIMENTS AND DETAILED DESCRIPTION

Figure 1A:
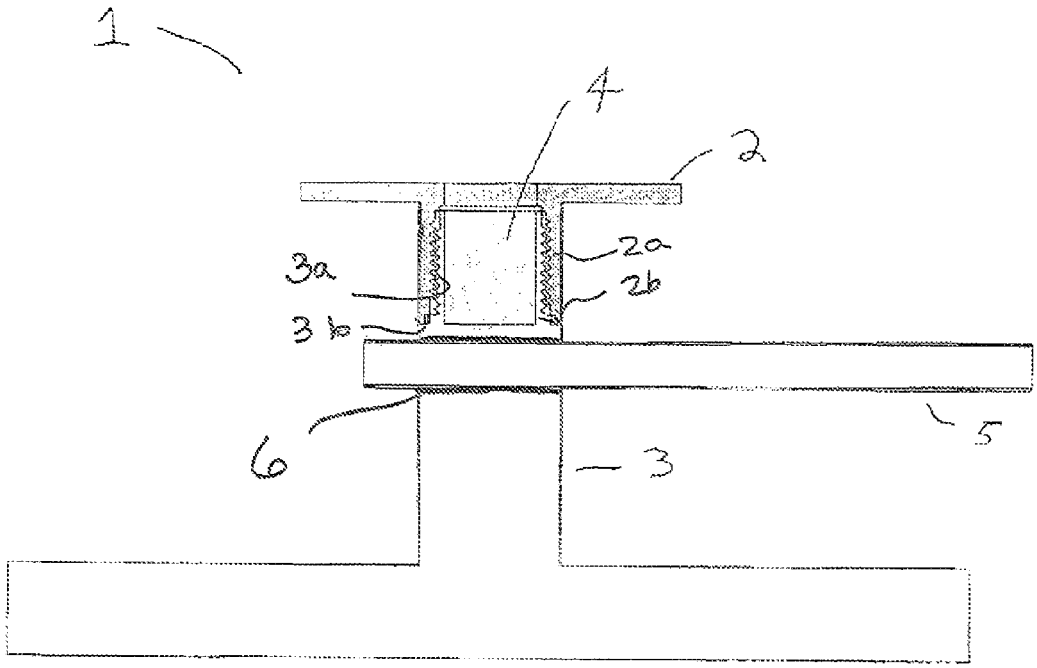
FIG. 1A depicts a cavity filter according to an embodiment of the present invention.

Exemplary embodiments for connecting a resonator, such as a top hat resonator, to a filter body of a cavity resonator are described herein and are shown by way of example in the drawings. Throughout the following description and drawings, like reference numbers/characters refer to like elements.

It should be understood that, although specific exemplary embodiments are discussed herein, there is no intent to limit the scope of present invention to such embodiments. To the contrary, it should be understood that the exemplary embodiments discussed herein are for illustrative purposes, and that modified and alternative embodiments may be implemented without departing from the scope of the present invention.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in a description of the process/method.

As used herein, the term "and/or" includes any and all combinations of one or more of the associated listed items. As used herein, the singular forms "a," "an" and "the" are intended to include the plural form, unless the context and common sense indicates otherwise.

As used herein, the term "embodiment" refers to an embodiment of the present invention.

As used herein the term "threaded" includes, but is not limited to, partially threaded.

FIG. 1A depicts a cavity filter 1 according to one embodiment. As shown the cavity filter 1 comprises a resonator 2 and filter body 3 that are connected using threaded portions 2*a*, 3*a*. For ease of explanation, threaded portion 2*a* may be referred to herein as a "first" threaded portion and portion 3*a* may be referred to as a "second" threaded portion, it being understood that these designations are arbitrary and may be reversed. In one embodiment, the first portion 2*a* may comprise a female type threaded portion 2*a* and the second threaded portion 3*a* may comprise a male type threaded portion 3*a*, though the type of threads may be modified or reversed. Yet further, the size of the threads used in both portions 2*a*, 3*a* may be 12 millimeters, for example. More generally, in embodiments of the invention the threaded portions may comprise variable thread sizes, where the size depends on the size of a re-entrant cavity 4.

Figure 1B:
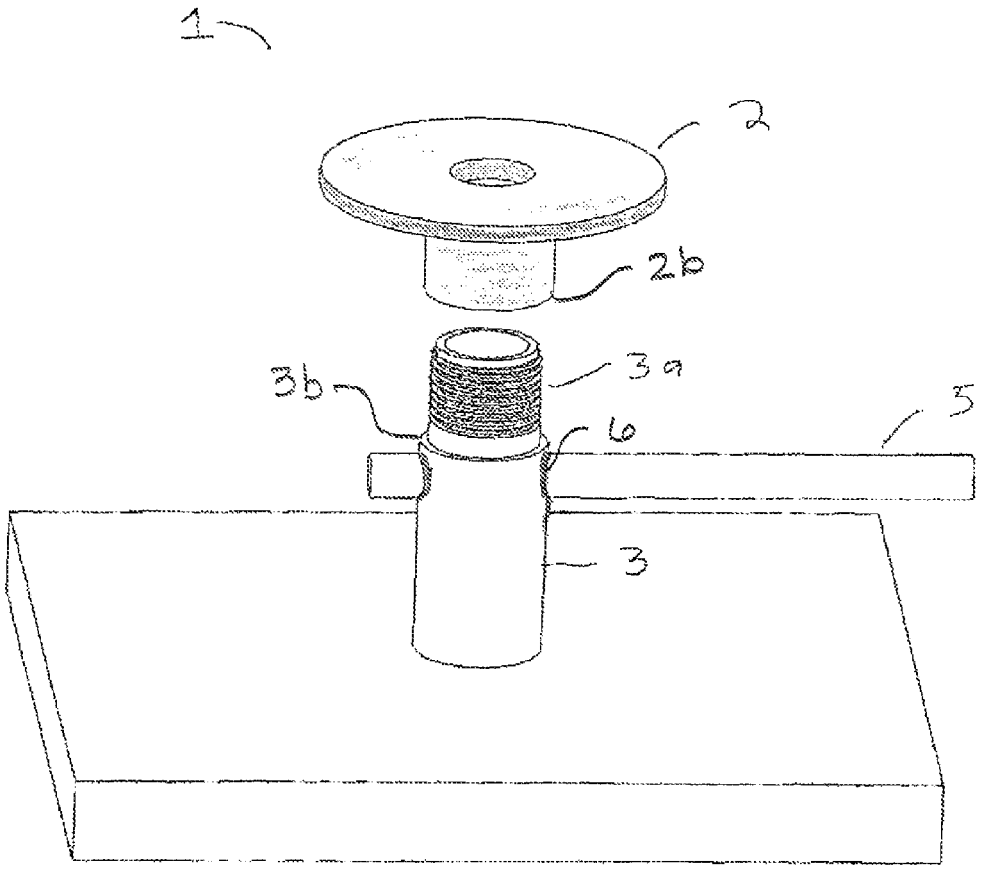
FIG. 1B depicts another view of the cavity filter in FIG. 1A according to an embodiment of the present invention.

FIG. 1B depicts another view of the cavity filter 1 in FIG. 1A according to an embodiment of the present invention.

As is evident from FIGS. 1A and 1B, the resonator 2, comprising the first threaded portion 2*a*, is configured to connect to the filter body 3 by connecting (e.g., threading) the first threaded portion 2*a* with the second threaded portion 3*a*. In the embodiment shown in FIGS. 1A and 1B the resonator 2 is a top hat resonator though other, similar resonators may be used.

Figure 2:
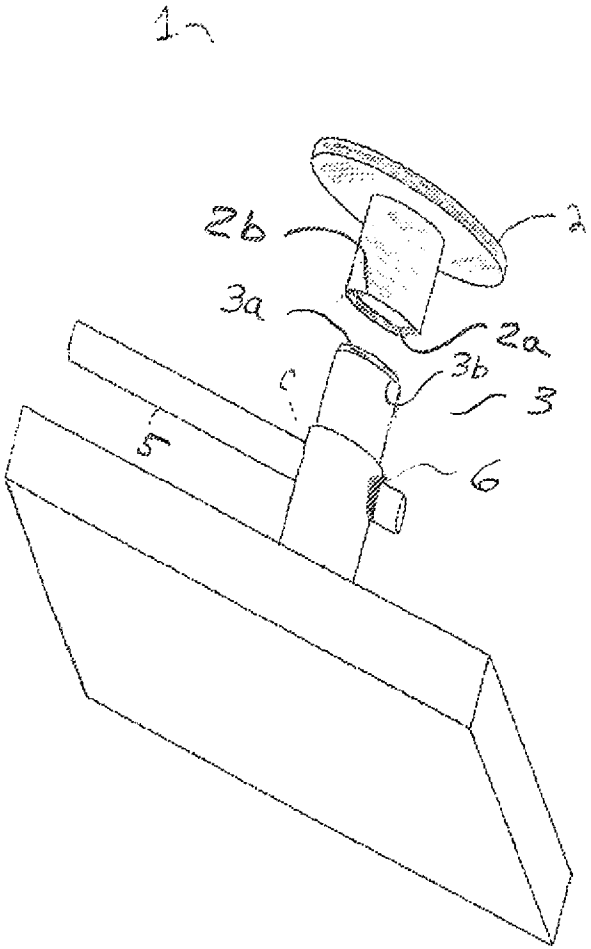
FIG. 2 depicts an exploded view of the cavity filter in FIGS. 1*a* and 1B according to an embodiment of the present invention.

FIG. 2 depicts an exploded view of the filter 1. In one embodiment of the invention, the filter 1 may be configured to operate over a range of frequencies, including 600 MHz to 960 MHz, 1650 MHz to 2700 MHz, and other frequency ranges, and may be a part of a tower mounted amplifier, or antenna, such as a low band tower mounted amplifier to name just one of the many types of amplifiers and antennas covered by the present invention.

FIG. 2 also depicts another feature of embodiments of the invention. In particular, the cavity 1 shown in FIG. 2 depicts contact areas 2*b*, 3*b* that are configured to form an electrical ground. In more detail, the resonator 2 may comprise a first contact area 2*b* while the filter body 3 may comprise a second contact area 3*b*. As before, the use of the designations "first" and "second" are arbitrary and may be reversed. In an embodiment, the first contact area 2*b* may comprise a thin "lip" that overlaps or makes contact with the second contact area 3*b*. The contact insures the formation of an electrical ground for the filter 1. Alternatively, the lip may be made a part of the second contact area so that the lip of the contact area formed as a part of the filter body 3 overlaps or makes contact with the contact area formed as a part of the resonator 2.

In the embodiments shown in FIGS. 1A, 1B and 2, the filter 1 further comprises a tap pin 5. In embodiments of the invention, the filter body 3 includes a tap pin passageway 6 for receiving the tap pin 5 at an exemplary, illustrative position "C" that allows an RF signal to be coupled into, or out of, the filter 1. It should be understood that the position "C" of tap pin passageway 6 as shown in FIG. 2 is purely for explanatory purposes herein, and the exact position of tap pin passageway 6 (as well the tap pin 5 itself) relative to filter body 3 may vary from that shown in FIG. 2. In embodiments of the invention, this position "C" of tap pin passageway 6 may be located closer to the resonator 2 than was previously possible due to the use of the threaded portions 2*a*, 3*a*. This results in increased coupling of the signal from the resonator 2 to the tap pin 5. In more detail, in traditional cavities a screw is used to connect the resonator 2 and filter body 3. Accordingly, there is the possibility that the screw may make contact with a tap pin 5, causing a short circuit and failure of the cavity 1. Thus, care must be taken to make sure the screw and tap pin are separated enough to avoid such a short circuit. This separation, however, decreases the coupling of the signal from the resonator to the tap pin. By eliminating the use of a screw, the above-described short circuit can be avoided and, further, the tap pin 5 can be located closer to the resonator 2. Accordingly, positioning of tap pin passageway 6 consistent with this disclosure results in increased, satisfactory coupling of an RF signal from tap pin 5 to the resonator 2. For example, in conventional designs that do not use embodiments of the invention, coupling may be degraded to the point where little of the RF signal is coupled to the tap pin. In sum, the filter body 3 may be configured to include the tap pin passageway 6 for receiving the tap pin 5 at a position "C" that provides a desired, satisfactory coupling of an RF signal from the tap pin 5 to the resonator 2.

While exemplary embodiments have been shown and described herein, it should be understood that variations of the disclosed embodiments may be made without departing from the spirit and scope of the claims that follow.

We claim:

1. A cavity filter comprising:

a top hat resonator having an outer surface and an opening therethrough with an inner surface, wherein one of the inner surface and the outer surface comprises a first threaded portion;

a filter body comprising a re-entrant cavity with a second threaded portion bounded by a base section of said filter body, the first threaded portion of the top hat resonator configured to connect to the second threaded portion of the filter body; and a tap pin passing through said filter body at a location such that the base section of said filter body is located between said tap pin and said re-entrant cavity.

2. The cavity filter as in claim 1, wherein the top hat resonator further comprises a first contact area, and the filter body further comprises a second contact area.

3. The cavity filter as in claim 2 wherein the first contact area is configured to contact the second contact area to connect said top hat resonator to an electrical ground.

4. The cavity filter as in claim 1 wherein the first threaded portion comprises threads that are about 12 millimeters in size, and the second threaded portion comprises threads that are about 12 millimeters in size.

5. The cavity filter as in claim 1, wherein the cavity filter is a part of a tower mounted amplifier or antenna.

6. The cavity filter as in claim 1, wherein the top hat resonator is configured to operate over a range of frequencies selected from at least 600 MHz to 960 MHz and 1650 MHz to 2700 MHz.

7. A filter body comprising a solid, generally cylindrical section;

a re-entrant cavity at an end of said cylindrical section and having a threaded portion bounded by a base section of the filter body, the threaded portion comprising threads and a tap pin passageway through said cylindrical section running about perpendicular to the cylindrical section threaded portion and located such that said base section is located between said tap pin passageway and said re-entrant cavity.

8. The filter body as in claim 7 further comprising a contact area configured to contact a top hat resonator contact area, thereby electrically grounding said top hat resonator.

9. The filter body as in claim 7 wherein the threaded portion comprises threads that are about 12 millimeters in size.

10. The filter body as in claim 7, further comprising a tap pin disposed within said tap pin passageway, said tap pin configured to deliver a radio frequency signal to said cylindrical section.

11. The filter body of claim 7, wherein said tap pin passageway is suitable to receive a tap pin configured to deliver radio frequency power to said filter body.

12. A method for connecting a top hat resonator to a filter body comprising:

connecting a top hat resonator to a filter body, the top hat resonator having an outer surface and an opening therethrough with an inner surface, wherein one of the inner surface and the outer surface comprises a first threaded portion having threads, and the filter body comprising a re-entrant cavity with a second threaded portion bounded by a base section of said filter body and a tap pin passing through said filter body such that said base section is located between said tap pin and the re-entrant cavity, where the connecting is performed by coupling together the first and second threaded portions.

13. The method as in claim 12, further comprising grounding the top hat resonator via a first contact area of the top hat resonator and a second contact area of the filter body.

14. The method as in claim 12, wherein the cavity filter is a part of a tower mounted amplifier or antenna.

15. The method as in claim 12, wherein the top hat resonator operates over a range of frequencies selected from at least 600 MHz to 960 MHz and 1650 MHz to 2700 MHz.

16. The method as in claim 12 wherein:

the first and second threaded portions are 12 millimeters in size.

* * * * *